US010066191B2

(12) United States Patent
Schmiedel et al.

(10) Patent No.: US 10,066,191 B2
(45) Date of Patent: Sep. 4, 2018

(54) WASHING OR CLEANING COMPOSITION HAVING IMPROVED FOAMING CHARACTERISTICS WITH A HIGH LEVEL OF SOILING

(71) Applicant: Henkel AG & Co. KGaA, Duesseldorf (DE)

(72) Inventors: Peter Schmiedel, Duesseldorf (DE); Walter Heberlein, Vienna (AT); Danilo Panzica, Hilden (DE); Ketan Patil, Langenfeld (DE); Dieter Nickel, Pulheim (DE); Ingrid Kraus, Duesseldorf (DE); Robin Kleinschnitz, Duesseldorf (DE); Hans-Henning Wenk, Muehlheim (DE); Dirk Kuppert, Aschaffenburg (DE); Juergen Lattich, Nidderau (DE); Ashraf Marzouk, Cairo (EG)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 15/235,205

(22) Filed: Aug. 12, 2016

(65) Prior Publication Data

US 2016/0348033 A1 Dec. 1, 2016

Related U.S. Application Data

(63) Continuation of application No. PCT/EP2014/053333, filed on Feb. 20, 2014.

(51) Int. Cl.

| | |
|---|---|
| ***C11D 3/00*** | (2006.01) |
| ***C11D 1/22*** | (2006.01) |
| ***C11D 1/90*** | (2006.01) |
| ***C11D 1/94*** | (2006.01) |
| ***C11D 11/00*** | (2006.01) |
| ***C11D 17/06*** | (2006.01) |
| ***D06F 39/08*** | (2006.01) |

(52) U.S. Cl.

CPC ..... *C11D 3/0094* (2013.01); *C11D 1/22* (2013.01); *C11D 1/90* (2013.01); *C11D 1/94* (2013.01); *C11D 11/0017* (2013.01); *C11D 17/06* (2013.01); *D06F 39/088* (2013.01)

(58) Field of Classification Search

CPC ..... C11D 3/0094; C11D 1/22; C11D 1/90; C11D 1/94; C11D 11/0017; C11D 17/06; D06F 39/088

See application file for complete search history.

(56) References Cited

U.S. PATENT DOCUMENTS

| | | | | |
|---|---|---|---|---|
| 2,809,650 | A * | 10/1957 | Anderson | D06F 13/02 137/13 |
| 3,158,615 | A | 11/1964 | Dunn et al. | |
| 4,062,647 | A | 12/1977 | Storm et al. | |
| 4,497,825 | A | 2/1985 | Bade | |
| 4,524,009 | A | 6/1985 | Valenty | |
| 4,639,325 | A | 1/1987 | Valenty et al. | |
| 4,664,839 | A | 5/1987 | Rieck | |
| 4,737,306 | A | 4/1988 | Wichelhaus et al. | |
| 4,816,553 | A | 3/1989 | Baur et al. | |
| 4,820,439 | A | 4/1989 | Rieck | |
| 4,985,553 | A | 1/1991 | Fuertes et al. | |
| 5,494,488 | A | 2/1996 | Arnoldi et al. | |
| 5,501,814 | A | 3/1996 | Engelskirchen et al. | |
| 5,541,316 | A | 7/1996 | Engelskirchen et al. | |
| 5,580,941 | A | 12/1996 | Krause et al. | |
| 5,780,420 | A | 7/1998 | Breuer et al. | |
| 5,783,616 | A | 7/1998 | Krause et al. | |
| 5,821,360 | A | 10/1998 | Engelskirchen et al. | |
| 5,830,956 | A | 11/1998 | Stockhausen et al. | |
| 5,847,065 | A | 12/1998 | Krause et al. | |
| 5,854,191 | A | 12/1998 | Krause et al. | |
| 5,854,321 | A | 12/1998 | Krause et al. | |
| 5,959,101 | A | 9/1999 | Engelskirchen et al. | |
| 6,187,055 | B1 | 2/2001 | Kottwitz et al. | |
| 6,506,719 | B1 | 1/2003 | Arvanitidou et al. | |
| 2010/0120658 | A1 * | 5/2010 | Schiedel | C11D 3/001 510/515 |

FOREIGN PATENT DOCUMENTS

| | | | |
|---|---|---|---|
| DE | 4417734 | A1 | 11/1995 |
| DE | 19540086 | A1 | 4/1997 |
| DE | 10162648 | A1 | 7/2003 |
| EP | 0026529 | A1 | 4/1981 |
| EP | 0150930 | A2 | 8/1985 |
| EP | 0427349 | A2 | 5/1991 |

(Continued)

OTHER PUBLICATIONS

PCT International Search Report (PCT/EP2014/053333) dated Sep. 10, 2014.

Certified British patent application 9419091, 1995.

*Primary Examiner* — Amina S Khan

(74) *Attorney, Agent, or Firm* — Thomas G. Krivulka

(57) ABSTRACT

The present invention relates to washing or cleaning agents having improved foaming characteristics under high soil loading, containing at least one anionic surfactant and at least one alkylamidopropyl betaine of formula $(R^1)C(=O)NH(CH_2)_3N^+(R^2)(R^3)CH_2COO^-$, where $R^1$ is an alkyl radical having 7 to 9 carbon atoms and $R^2$ and $R^3$ are identical or different alkyl radicals having 1 to 3 carbon atoms, wherein the weight ratio of the alkylamidopropyl betaine defined herein/total amount of anionic surfactant in the washing or cleaning agent is from 0.003 to 0.12, wherein the weight ratio of the total amount of alkylamidopropyl betaine as defined herein/total amount of alkylamidopropyl betaine in the washing or cleaning agent is 0.25 to 1.0, to washing or cleaning methods in which washing or cleaning agents of this kind are used.

6 Claims, No Drawings

(56) References Cited

FOREIGN PATENT DOCUMENTS

| | | | |
|---|---|---|---|
| EP | 0472042 | A1 | 2/1992 |
| EP | 0542496 | A1 | 5/1993 |
| EP | 0711545 | A1 | 5/1996 |
| EP | 0727448 | A1 | 8/1996 |
| EP | 1739161 | A1 | 1/2007 |
| JP | 5-339896 | A | 12/1993 |
| WO | 92/18542 | A1 | 10/1992 |
| WO | 95/07303 | A1 | 3/1995 |
| WO | 95/12619 | A1 | 5/1995 |
| WO | 95/20029 | A1 | 7/1995 |

* cited by examiner

WASHING OR CLEANING COMPOSITION HAVING IMPROVED FOAMING CHARACTERISTICS WITH A HIGH LEVEL OF SOILING

FIELD OF THE INVENTION

The present invention generally relates to washing or cleaning agents having improved foaming characteristics under high soil loading, which agents contain anionic surfactants and alkylamidopropyl betaines (APBs), and to the use thereof.

BACKGROUND OF THE INVENTION

In many parts of the world, for example in many North African, Arab or Asian countries, washing machines of a simpler type of construction than in Central Europe are common. Many such machines do not have a drum rotating in a liquor tank, which is configured as a front or top loader, but rather have only a stirring or circulating device in a static liquor tank. This stirring or circulating device (agitator) may be located on the bottom of the liquor tank or, in simple embodiments, on the side. During the washing operation, the agitator may carry out a reversing rotational movement with standstill phases, or else may rotate continuously in the same direction. Such washing machines without a rotating drum will be referred to hereinbelow also as "tub-type washing machines".

In many areas of the world, particularly those having a shortage of water, it is customary not to discard the washing liquor of a wash cycle immediately after the end of the wash cycle but rather to use the same washing liquor for multiple wash loads one after the other. In this case, the consumer often considers the disappearance of the foam as the washing liquor becomes increasingly soiled to be an indicator of the depletion of the washing power, which nevertheless need not necessarily be the case since although the soil in the washing liquor has a defoaming effect, this need not mean that the cleaning ability of the washing liquor is no longer ensured. For this reason, however, a high foaming capacity is to be regarded as an advantage for consumers. This advantage is even more pronounced, the stronger the foaming capacity remains as the washing liquor becomes increasingly soiled. Such an improvement in the foaming capacity indicates to the consumer a higher washing power and in particular a greater "range" of the washing agent.

Consumers who use tub-type washing machines often counter the loss of foam and the suspected loss of washing power by adding more washing agent. A washing agent which under these conditions produces a stable and esthetic foam will be regarded by the consumer as being of higher performance.

In order to achieve sufficient foam formation and foam stability, it is known to add foam-promoting compounds, so-called "foam boosters", to washing, cleaning or dishwashing agents. For example, the use of alkyl ether carboxylates as foam-promoting compounds is known from EP 1739161 A1.

EP 0711545 B1 discloses betaines, in particular alkylamidopropyl betaines, as surfactants for cosmetic purposes and as cleaning agents and bases this on the low irritant effect of $C_{8/10}$APB. DE 2926479 B1 discloses the preparation of $C_6$-$C_{18}$ alkylamidopropyl betaines.

However, it is known that an excessively high foaming capacity leads to losses in terms of washing performance and, in the washing machines with a rotating drum which are used in Central Europe, to malfunctions caused for example by excessive foaming. The latter effect is admittedly less pronounced in tub-type washing machines, but still occurs to a certain extent. Conventional high-suds washing agents having a formulation rich in anionic surfactant(s) and without any defoaming ingredients generally exhibit a sufficient foaming capacity at the start of a wash cycle. Here, increasing the foaming capacity would lead to excessive foaming, even in these tub-type washing machines. Increasing the foaming capacity in the absence of soil would therefore not be advantageous here.

The same is true in the field of cleaning agents. This is because, in this case too, there is a need for cleaning agents which have a high foaming capacity under high soil loading. In the case of agents for washing dishes by hand, and also in the case of agents for washing clothes by hand, such as travel washing agents for example, it is likewise desired to achieve a good foaming capacity under high soil loading. This is because, in this case too, the foam serves for the consumer as an at least presumed indicator of the cleaning performance. Also in the field of sanitary cleaning products, it would be desirable to provide a product which has an excellent foaming capacity in the presence of high soil loading. This is because, especially in the sanitary sector, the consumer associates a good foam formation with a good and thorough cleaning power against microorganisms.

It was therefore an object of the invention to provide a washing or cleaning agent having improved foaming characteristics under high soil loading. In particular, one object was to provide a washing or cleaning agent which does not give rise to any significant increase in the foaming capacity in the absence of soil, but rather increases the foaming capacity only in the presence of soil. The washing or cleaning agent was further intended to increase the foaming capacity again when added to a washing or cleaning liquor that no longer foams due to high soil loading, and to produce a stable and esthetically pleasing foam even in the presence of relatively large amounts of soil, in particular after multiple successive washing or cleaning cycles.

The inventors have now surprisingly discovered that this object can be achieved by a washing or cleaning agent which contains short-chain alkylamidopropyl betaines in combination with anionic surfactants in particular quantity ratios. The quantity ratio of the short-chain alkylamidopropyl betaines to the total content of alkylamidopropyl betaines must also be set.

Furthermore, other desirable features and characteristics of the present invention will become apparent from the subsequent detailed description of the invention and the appended claims, taken in conjunction with this background of the invention.

BRIEF SUMMARY OF THE INVENTION

A washing or cleaning agent, preferably a washing agent, particularly preferably a solid washing agent, containing: (i) anionic surfactant, wherein the total amount of anionic surfactant is 3% by weight to 25% by weight, preferably 5% by weight to 20% by weight, based on the total weight of the washing or cleaning agent, wherein the agent includes at least one first anionic surfactant, wherein preferably the at least one first anionic surfactant is an alkylbenzene sulfonate; and (ii) at least one alkylamidopropyl betaine of formula $(R^1)C(=O)NH(CH_2)_3N^+(R^2)(R^3)CH_2COO^-$, where $R^1$ is an alkyl radical, preferably a linear alkyl radical, having 7 to 9 carbon atoms and $R^2$ and $R^3$ are identical or different alkyl radicals having 1 to 3 carbon atoms, preferably methyl; wherein the weight ratio of the alkylamidopropyl betaine according to (ii)/total amount of anionic surfactant in the washing or cleaning agent is from 0.003 to 0.12, preferably from 0.01 to 0.06, particularly preferably from 0.02 to 0.04, wherein the weight ratio of the total amount of alkylamidopropyl betaine according to (ii)/total amount of alkylamidopropyl betaine in the washing or cleaning agent is 0.25 to 1.0, particularly preferably 0.5 to 1.0.

The use of at least one alkylamidopropyl betaine for improving the foaming characteristics of a washing or cleaning agent, in particular in the presence of soil, wherein (i) the washing or cleaning agent contains anionic surfactant, wherein the total amount of anionic surfactant is 3% by weight to 25% by weight, preferably 5% by weight to 20% by weight, based on the total weight of the washing or cleaning agent, wherein the agent includes at least one first anionic surfactant, wherein preferably the at least one first anionic surfactant is an alkylbenzene sulfonate; and (ii) the at least one alkylamidopropyl betaine is a compound of formula $(R^1)C(=O)NH(CH_2)_3N^+(R^2)(R^3)CH_2COO^-$, where $R^1$ is an alkyl radical, preferably a linear alkyl radical, having 7 to 9 carbon atoms and $R^2$ and $R^3$ are identical or different alkyl radicals having 1 to 3 carbon atoms, preferably methyl; (iii) the weight ratio of alkylamidopropyl betaine according to (ii)/total amount of anionic surfactant in the washing or cleaning agent is from 0.003 to 0.12, preferably from 0.01 to 0.06, particularly preferably from 0.02 to 0.04; and (iv) the weight ratio of the total amount of alkylamidopropyl betaine according to (ii)/total amount of alkylamidopropyl betaine in the washing or cleaning agent is 0.25 to 1.0, particularly preferably 0.5 to 1.0.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

In a first aspect, the invention therefore relates to a washing or cleaning agent, preferably a washing agent, particularly preferably a solid washing agent, containing:

(i) anionic surfactant, wherein the total amount of anionic surfactant is 3% by weight to 25% by weight, preferably 5% by weight to 20% by weight, based on the total weight of the washing or cleaning agent, wherein the agent includes at least one first anionic surfactant, wherein preferably the at least one first anionic surfactant is an alkylbenzene sulfonate; and (ii) at least one alkylamidopropyl betaine of formula $(R^1)C(=O)NH(CH_2)_3N^+(R^2)(R^3)CH_2COO^-$, where $R^1$ is an alkyl radical, preferably a linear alkyl radical, having 7 to 9 carbon atoms and $R^2$ and $R^3$ are identical or different alkyl radicals having 1 to 3 carbon atoms, preferably methyl;

wherein the weight ratio of the alkylamidopropyl betaine according to (ii)/total amount of anionic surfactant in the washing or cleaning agent is from 0.003 to 0.12, preferably from 0.01 to 0.06, particularly preferably from 0.02 to 0.04, wherein the weight ratio of the total amount of alkylamidopropyl betaine according to (ii)/total amount of alkylamidopropyl betaine in the washing or cleaning agent is 0.25 to 1.0, particularly preferably 0.5 to 1.0.

In some embodiments, the total amount of anionic surfactant is 3% by weight to 25% by weight, 5% by weight to 20% by weight, 7% by weight to 18% by weight, 9% by weight to 16% by weight, 11% by weight to 14% by weight, 3% by weight to 20% by weight, 3% by weight to 18% by weight or 5% by weight to 18% by weight, based on the total weight of the washing or cleaning agent, wherein the agent includes at least one first anionic surfactant.

In different embodiments, the weight ratio of alkylamidopropyl betaine according to (ii)/total amount of anionic surfactant in the washing or cleaning agent is from 0.005 to 0.10, preferably from 0.007 to 0.09, from 0.008 to 0.08, from 0.009 to 0.08, from 0.01 to 0.07, from 0.011 to 0.06, from 0.012 to 0.05, from 0.015 to 0.04, or from 0.02 to 0.03, particularly preferably from 0.02 to 0.04.

In some embodiments, the weight ratio of the total amount of alkylamidopropyl betaine according to (ii)/total amount of alkylamidopropyl betaine in the washing or cleaning agent is from 0.25 to 1.0, from 0.30 to 1.0, from 0.40 to 1.0, from 0.5 to 1.0, from 0.6 to 1.0, from 0.7 to 1.0, from 0.8 to 1.0, from 0.9 to 1.0, particularly preferably 1.0.

In some embodiments, the washing or cleaning agents according to the invention include no cocoamidopropyl betaine. Cocoamidopropyl betaine is a mixture of $C_8$-$C_{18}$ alkylamidopropyl betaine, as disclosed in EP 0711545 B1. This means that, in certain embodiments, the short-chain alkylamidopropyl betaines do not stem from cocoamidopropyl betaine.

When, in the context of the present invention, mention is made of $C_8$-$C_{18}$ or for example $C_8/C_{10}$ alkylamidopropyl betaines, the stated number of carbon atoms refers not only to the carbon atoms of the alkyl chain but also includes the carbonyl carbon atom of the amide group. The situation is different when a specific structural formula is shown, in which case the radical $R^1$ concerns only the carbon atoms of the alkyl chain.

It has surprisingly been found that such a washing or cleaning agent, in the presence of soil, has a better foaming capacity than a comparable washing or cleaning agent from the prior art having the same or even a higher total surfactant concentration. The foaming capacity is increased in particular in the presence of soil, while only a slight, if any, foam-improving effect is observed in a washing or cleaning liquor without soil loading. This is advantageous for the consumer since excessive foaming of the initially clean washing or cleaning liquor can thus be avoided. Finally, it has been found that the washing or cleaning agent formulations according to the invention have an improved foam quality in a soil-loaded washing or cleaning liquor. Under otherwise identical conditions, the foam of the washing or cleaning agents according to the invention appears to be whiter and creamier. The improved foaming capacity is understood by the consumer to be an indicator of a higher cleaning capability and a greater range of the washing or cleaning agent. This is advantageous with regard to environmental and sustainability properties.

This is because, given good foaming characteristics of the washing or cleaning liquor which last under increased soiling, the consumer will change the washing or cleaning liquor less frequently and thus will save water and washing or cleaning agent. In addition to a cost saving, this is also better for the environment.

It has surprisingly been discovered that specifically the short-chain alkylamidopropyl betaines in combination with anionic surfactants, within the mixing ratios according to the invention, have excellent foaming characteristics in the presence of soil. The "blending" of short-chain alkylamidopropyl betaines with longer-chain alkylamidopropyl betaines, such as for example in cocoamidopropyl betaine, does not exhibit this behavior. It has thus been found that the advantageous effect cannot be achieved in this constellation.

Moreover, the use of short-chain alkylamidopropyl betaines ensures good skin tolerance of the washing or cleaning agent when the consumer comes into contact with the washing or cleaning agent or with the washed or cleaned articles. In addition, the short-chain alkylamidopropyl betaines are effective in particularly small amounts in the ratios described herein to the anionic surfactants. The claimed washing or cleaning agent compositions are therefore particularly cost-effective.

In certain embodiments, the proportion of short-chain alkylamidopropyl betaine in the composition is 0.009 to 4.2% by weight, preferably 0.03 to 4.0% by weight, more preferably 0.1 to 3.5% by weight, even more preferably 0.2 to 3.0% by weight, particularly preferably 0.5 to 2.0% by weight.

Washing or cleaning agents which have at least one alkylbenzene sulfonate as anionic surfactant are particularly suitable.

In certain embodiments, the at least one alkylbenzene sulfonate is a linear or branched $C_{6-19}$ alkylbenzene sulfonate, preferably a linear $C_{9-13}$ alkylbenzene sulfonate (LAS).

In some embodiments, the at least one anionic surfactant of the washing or cleaning agent is at least one alkylbenzene sulfonate, wherein the amount of alkylbenzene sulfonate is 3% by weight to 25% by weight, 5% by weight to 20% by weight, 7% by weight to 18% by weight, 9% by weight to 16% by weight, 11% by weight to 14% by weight, 3% by weight to 20% by weight, 3% by weight to 18% by weight or 5% by weight to 18% by weight, based on the total weight of the washing or cleaning agent. Preferably, the at least one alkylbenzene sulfonate is an LAS.

In certain variants, the washing or cleaning agent contains exclusively alkylbenzene sulfonate, preferably LAS, as anionic surfactant.

Without wishing to be bound to one theory, it is assumed that the washing or cleaning agents according to the invention, under high soil loading, have a higher foam production rate than comparable washing agents or comparable cleaning agents. Since the foam degradation rate due to coalescence is proportional to the amount of foam that exists, the equilibrium foam level for the washing agents according to the invention is higher due to the increased rate of production.

In a further aspect, the invention relates to a washing or cleaning method, comprising the method steps:

(i) providing a washing or cleaning solution including a washing or cleaning agent as described herein, wherein the washing or cleaning solution preferably includes soil;

(ii) bringing a soiled object, preferably a soiled fabric, in particular a soiled flat fabric, into contact with the washing or cleaning solution according to (i).

Yet another aspect is directed to the use of at least one alkylamidopropyl betaine for improving the foaming characteristics of a washing or cleaning agent, in particular in the presence of soil, wherein (i) the washing or cleaning agent contains anionic surfactant, wherein the total amount of anionic surfactant is 3% by weight to 25% by weight, preferably 5% by weight to 20% by weight, based on the total weight of the washing or cleaning agent, wherein the agent includes at least one first anionic surfactant, wherein preferably the at least one first anionic surfactant is an alkylbenzene sulfonate; and (ii) the at least one alkylamidopropyl betaine is a compound of formula $(R^1)C(=O)NH(CH_2)_3N^+(R^2)(R^3)CH_2COO^-$, where $R^1$ is an alkyl radical, preferably a linear alkyl radical, having 7 to 9 carbon atoms and $R^2$ and $R^3$ are identical or different alkyl radicals having 1 to 3 carbon atoms, preferably methyl;

(iii) the weight ratio of alkylamidopropyl betaine according to (ii)/total amount of anionic surfactant in the washing or cleaning agent is from 0.003 to 0.12, preferably from 0.01 to 0.06, particularly preferably from 0.02 to 0.04; and (iv) the weight ratio of the total amount of alkylamidopropyl betaine according to (ii)/total amount of alkylamidopropyl betaine in the washing or cleaning agent is 0.25 to 1.0, particularly preferably 0.5 to 1.0.

Unless stated otherwise, all the amounts specified in connection with the washing or cleaning agents described herein refer to % by weight, in each case based on the total weight of the washing or cleaning agent. Furthermore, unless explicitly stated otherwise, such specified amounts relating to at least one constituent always refer to the total amount of this type of constituent contained in the agent. This means that such specified amounts, for example in connection with "at least one anionic surfactant", refer to the total amount of anionic surfactants contained in the agent.

What is stated in connection with the washing or cleaning agents according to the invention also applies to the methods and uses according to the invention.

In a further aspect, the present invention relates to the use of the washing or cleaning agents defined herein as washing or cleaning agents. In particular, the present invention relates to the use of the washing or cleaning agents defined herein as fabric washing agents, washing agents for washing by hand, travel washing agents, washing-up agents, in particular dishwashing agents, particularly preferably agents for washing dishes by hand, or toilet cleaners. By way of example, the composition according to the invention produces in a sink an excellent foam in the cleaning liquor when the liquor is soiled.

"At least one", as used herein, refers to 1 or more, for example 1, 2, 3, 4, 5, 6, 7, 8, 9 or more. In connection with constituents of the compositions described herein, this term refers not to the absolute amount of molecules but rather to the type of constituent. Therefore, "at least one anionic surfactant" means for example one or more different anionic surfactants, that is to say one or more different types of anionic surfactants. Together with specified amounts, the specified amounts refer to the total amount of the correspondingly designated type of constituent, as already defined above.

The alkylamidopropyl betaines described herein are preferably linear C8 or C10 alkylamidopropyl betaines, that is to say caprylamidopropyl betaine (N-(3-octanoyl)aminopropyl)-N-carboxymethyl-N,N-dimethyl-1-propanaminium) or capramidopropyl betaine (N-(3-decanoyl)aminopropyl)-N-carboxymethyl-N,N-dimethyl-1-propanaminium), or, very particularly preferably, mixtures of linear C8 and C10 alkylamidopropyl betaines. Such a betaine mixture is commercially available for example as Tegotens® B 810 from Evonik Industries.

Preferably, the washing or cleaning agents according to the invention contain alkylamidopropyl betaines which are substantially short-chain.

Short-chain alkylamidopropyl betaines are compounds of formula $(R^1)C(=O)NH(CH_2)_3N^+(R^2)(R^3)CH_2COO^-$, where $R^1$ is an alkyl radical, preferably a linear alkyl radical, having 7 to 9 carbon atoms and $R^2$ and $R^3$ are identical or different alkyl radicals having 1 to 3 carbon atoms, preferably methyl.

As anionic surfactants, use is made for example of those of the sulfonate and sulfate type. Suitable surfactants of the sulfonate type are preferably $C_{9-13}$ alkylbenzene sulfonates, olefin sulfonates, that is to say mixtures of alkene and hydroxyalkane sulfonates and disulfonates, as obtained for example from $C_{12-18}$ monoolefins having an end or internal double bond by sulfonation with gaseous sulfur trioxide and subsequent alkali or acid hydrolysis of the sulfonation products. Also suitable are alkane sulfonates obtained from $C_{12-18}$ alkanes for example by sulfochlorination or sulfoxidation with subsequent hydrolysis and/or neutralization. Also suitable are the esters of α-sulfo fatty acids (ester sulfonates), for example the α-sulfonated methyl esters of hydrogenated coconut, palm kernel or tallow fatty acids.

Suitable alkylbenzene sulfonates are preferably selected from linear or branched alkylbenzene sulfonates of formula

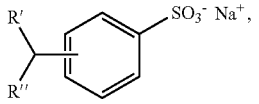

in which R' and R" independently are H or alkyl and together contain 6 to 19, preferably 7 to 15 and in particular 9 to 13 C atoms. One representative to which very particular preference is given is sodium dodecyl benzyl sulfonate.

As alk(en)yl sulfates, preference is given to the alkali metal and in particular the sodium salts of the sulfuric acid half-esters of $C_{12}$-$C_{18}$ fatty alcohols, for example of coconut fatty alcohol, tallow fatty alcohol, lauryl, myristyl, cetyl or stearyl alcohol or of the $C_{10}$-$C_{20}$ oxo alcohols and those half-esters of secondary alcohols of these chain lengths. Also preferred are alk(en)yl sulfates of the aforementioned chain length which contain a synthetic, petrochemically produced, straight-chain alkyl radical, which have an analogous degradation behavior to the adequate compounds based on fatty chemical raw materials. From the washing point of view, preference is given to the $C_{12}$-$C_{16}$ alkyl sulfates and $C_{12}$-$C_{15}$ alkyl sulfates and $C_{14}$-$C_{15}$ alkyl sulfates.

Also suitable are the sulfuric acid monoesters of the straight-chain or branched $C_{7-21}$ alcohols ethoxylated with 1 to 6 mol ethylene oxide, such as 2-methyl-branched $C_{9-11}$ alcohols having on average 3.5 mol ethylene oxide (EO) or $C_{12-18}$ fatty alcohols having 1 to 4 EO. Suitable alkyl ether sulfates are for example compounds of formula $$R^1—O-(AO)_n—SO_3^-X^+$$

In this formula, $R^1$ is a linear or branched, substituted or unsubstituted alkyl radical, preferably a linear, unsubstituted alkyl radical, particularly preferably a fatty alcohol radical. Preferred radicals $R^1$ are selected from decyl, undecyl, dodecyl, tridecyl, tetradecyl, pentadecyl, hexadecyl, heptadecyl, octadecyl, nonadecyl, eicosyl radicals and mixtures thereof, preference being given to the representatives having an even number of C atoms. Particularly preferred radicals $R^1$ are derived from $C_{12}$-$C_{18}$ fatty alcohols, for example from coconut fatty alcohol, tallow fatty alcohol, lauryl, myristyl, cetyl or stearyl alcohol or from $C_{10}$-$C_{20}$ oxo alcohols. AO stands for an ethylene oxide (EO) or propylene oxide (PO) group, preferably for an ethylene oxide group. The index n represents an integer from 1 to 50, preferably from 1 to 20 and in particular from 2 to 10. Very particularly preferably, n represents the numbers 2, 3, 4, 5, 6, 7 or 8. X represents a monovalent cation or the $n^{th}$ moiety of an n-valent cation, preference being given to the alkali metal ions and among these to $Na^+$ or $K^+$, $Na^+$ being extremely preferred. Further cations $X^+$ may be selected from $NH_4^+$, ½$Zn_2^+$, ½$Mg^{2+}$, ½$Ca^{2+}$, ½$Mn^{2+}$, and mixtures thereof.

In different embodiments, the alkyl ether sulfate may be selected from fatty alcohol ether sulfates of formula

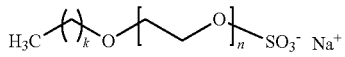

where k=11 to 19, n=2, 3, 4, 5, 6, 7 or 8. Very particularly preferred representatives are Na—$C_{12-14}$ fatty alcohol ether sulfates having 2 EO (k=11-13, n=2 in formula A-1). The specified degree of ethoxylation is a statistical mean value which for a specific product may be an integer or fractional number. The specified degrees of alkoxylation are statistical mean values which for a specific product may be an integer or fractional number. Preferred alkoxylates/ethoxylates have a narrowed homolog distribution (narrow range ethoxylates, NRE).

In the context of the present invention, the term "anionic surfactants" does not encompass soaps. The washing or cleaning agents according to the invention may include soaps but said soaps are not assigned to the anionic surfactants in the context of the present invention.

Soaps are therefore considered as additional constituents of the washing or cleaning agents. Suitable soaps are saturated fatty acid soaps, such as the salts of lauric acid, myristic acid, palmitic acid, stearic acid, hydrogenated erucic acid and behenic acid and also soap mixtures derived in particular from natural fatty acids, for example coconut, palm kernel or tallow fatty acids.

The anionic surfactants and soaps may be in the form of their sodium, potassium or ammonium salts or as soluble salts of organic bases, such as mono-, di- or triethanolamine. Preferably, the anionic surfactants and soaps are in the form of their sodium, potassium or magnesium salts, in particular in the form of the sodium salts.

When selecting the anionic surfactants, there are no boundary conditions to be observed which stand in the way of the freedom of formulation. The only thing to be taken into account is the fact that soaps are not counted among the anionic surfactants. Anionic surfactants to be used with preference are the alkylbenzene sulfonates and fatty alcohol sulfates, in particular the alkylbenzene sulfonates.

Anionic surfactants, that is to say in particular alkylbenzene sulfonates and alkyl ether sulfates, are contained in the washing or cleaning agents preferably in a specific proportion by weight, namely 3 to 25% by weight, based on the total weight of the washing or cleaning agent formulation. Preference is given to amounts of 5 to 20% by weight anionic surfactants, based on the total weight of the washing agent formulation. Regardless of whether the washing agent contains one or more of the anionic surfactants, the specified amounts refer to the total amount of all anionic surfactants contained in the washing agent. In certain embodiments, the washing or cleaning agents further include soaps, preferably 0.1 to 5% by weight of soaps. Preferably, the washing or cleaning agents do not contain any soaps.

Besides the described anionic surfactants and short-chain alkylamidopropyl betaines, the washing or cleaning agents may of course contain conventional ingredients of such agents. Here, mention may be made primarily of further surfactants, in particular non-ionic surfactants, builder substances and bleaching agents, enzymes and other active substances. Quite generally, the washing or cleaning agent may contain further ingredients which further improve the use and/or esthetic properties of the washing agent. In the context of the present invention, the washing or cleaning agent preferably additionally contains one or more substances from the group consisting of enzymes, bleaching agents, bleach activators, complexing agents, builders, electrolytes, non-aqueous solvents, pH adjusting agents, perfumes, perfume carriers, fluorescing agents, optical brighteners, dyes, speckles, hydrotropes, silicone oils, anti-redeposition agents, graying inhibitors, shrinkage preventers, anti-crease agents, color transfer inhibitors, antimicrobial active substances, germicides, fungicides, antioxidants, preservatives, corrosion inhibitors, antistatic agents, bittering agents, ironing adjuvants, proofing and impregnating agents, swelling and anti-slip agents, softening components and UV absorbers.

In the case where the washing or cleaning agents according to the invention as defined herein do not include any soap, the compositions may nevertheless contain speckles which have soap components. In this case, the composition contains soaps only in the speckles.

As non-ionic surfactants, use is made of preferably alkoxylated, advantageously ethoxylated, in particular primary alcohols having preferably 8 to 18 C atoms and on average 1 to 12 mol ethylene oxide (EO) per mole of alcohol, in which the alcohol residue may be linear or preferably methyl-branched in the 2-position or linear and methyl-branched residues may be contained in the mixture, as are usually present in oxo alcohol residues. However, particular preference is given to alcohol ethoxylates having linear residues of alcohols of native origin having 12 to 18 C atoms, for example of coconut, palm or tallow fatty alcohol or oleyl alcohol, and on average 2 to 8 EO per mole of alcohol. The preferred ethoxylated alcohols include for example $C_{12-14}$ alcohols having 3 EO or 4 EO, $C_{9-11}$ alcohol having 7 EO, $C_{13-15}$ alcohols having 3 EO, 5 EO, 7 EO or 8 EO, $C_{12-18}$ alcohols having 3 EO, 5 EO or 7 EO, and mixtures thereof, such as mixtures of $C_{12-14}$ alcohol having 3 EO and $C_{12-18}$ alcohol having 5 EO. The specified degrees of ethoxylation are statistical mean values which for a specific product may be an integer or fractional number. Preferred alcohol ethoxylates have a narrowed homolog distribution (narrow range ethoxylates, NRE). In addition to these non-ionic surfactants, use may also be made of fatty alcohols having more than 12 EO. Examples of these are tallow fatty alcohol having 14 EO, 25 EO, 30 EO or 40 EO.

A further class of preferably used non-ionic surfactants, which are used either as the sole non-ionic surfactant or in combination with other non-ionic surfactants, are alkoxylated, preferably ethoxylated or ethoxylated and propoxylated fatty acid alkyl esters, preferably having 1 to 4 carbon atoms in the alkyl chain, in particular fatty acid methyl esters.

A further class of non-ionic surfactants which can advantageously be used are the alkyl polyglycosides (APGs). Alkyl polyglycosides which can be used satisfy the general formula $RO(G)_z$, in which R is a linear or branched, in particular methyl-branched in the 2-position, saturated or unsaturated, aliphatic radical having 8 to 22, preferably 12 to 18 C atoms, and G is the symbol representing a glycose unit having 5 or 6 C atoms, preferably glucose. The degree of glycosylation z is between 1.0 and 4.0, preferably between 1.0 and 2.0 and in particular between 1.1 and 1.4. Use is preferably made of linear alkyl polyglycosides, that is to say alkyl polyglycosides in which the polyglycosyl radical is a glucose radical and the alkyl radical is an n-alkyl radical.

Non-ionic surfactants of the amine oxide type, for example N-coco-alkyl-N,N-dimethyl amine oxide and N-tallow-alkyl-N,N-dihydroxyethyl amine oxide, and of the fatty acid alkanol amide type may also be suitable. The amount of these non-ionic surfactants is preferably no more than that of the ethoxylated fatty alcohols, in particular no more than half thereof.

Builder substances are another important group of washing or cleaning agent ingredients. This substance class is understood to mean both organic and inorganic builder substances. These are compounds which may both perform a carrier function in the agents according to the invention and act as a water-softening substance during use.

Usable organic builder substances are for example the polycarboxylic acids which can be used in the form of their sodium salts, polycarboxylic acids being understood to mean those carboxylic acids which bear more than one acid function. By way of example, these are citric acid, adipic acid, succinic acid, glutaric acid, malic acid, tartaric acid, maleic acid, fumaric acid, sugar acids, aminocarboxylic acids, nitrilotriacetic acid (NTA), provided that such a use is not objectionable for ecological reasons, and mixtures thereof. Preferred salts are the salts of polycarboxylic acids, such as citric acid, adipic acid, succinic acid, glutaric acid, tartaric acid, sugar acids and mixtures thereof. The acids per se can also be used. Besides their builder effect, the acids typically also have the property of an acidification component and thus serve also, such as for example in the granules according to the invention, for setting a lower and milder pH of washing or cleaning agents. Mention may be made in particular here of citric acid, succinic acid, glutaric acid, adipic acid, gluconic acid, and any mixtures thereof.

Also suitable as builders are polymeric polycarboxylates. These are for example the alkali metal salts of polyacrylic acid or of polymethacrylic acid, for example those having a relative molecular weight of 500 to 70,000 g/mol. This substance class has already been described in detail above. The (co)polymeric polycarboxylates may be used either as a powder or as an aqueous solution. The content of (co) polymeric polycarboxylates in the agent is preferably 0.5 to 20% by weight, in particular 3 to 10% by weight.

In order to improve the water solubility, the polymers may also contain allylsulfonic acids, such as for example in EP 0727448 B allyloxybenzenesulfonic acid and methallylsulfonic acid, as monomer. Particular preference is also given to biodegradable polymers composed of more than two different monomer units, for example those which according to DE 4300772 A contain salts of acrylic acid and of maleic acid as well as vinyl alcohol or vinyl alcohol derivatives as monomers or those which according to DE 4221381 C contain salts of acrylic acid and of 2-alkylallylsulfonic acid as well as sugar derivatives as monomers. Further preferred copolymers are those which are described in German patent applications DE 4303320 A and DE 4417734 A and which preferably contain acrolein and acrylic acid/acrylic acid salts or acrolein and vinyl acetate as monomers. As further preferred builder substances, mention may also be made of polymeric aminodicarboxylic acids, the salts thereof or the precursor substances thereof. Particular preference is given to polyaspartic acids and the salts and derivatives thereof, for which it is disclosed in German patent application DE 19540086 A that these have a bleach-stabilizing effect in addition to cobuilder properties.

Further suitable builder substances are polyacetals which can be obtained by reacting dialdehydes with polyol carboxylic acids having 5 to 7 C atoms and at least 3 hydroxyl groups, for example as described in European patent application EP 0280223 A. Preferred polyacetals are obtained from dialdehydes such as glyoxal, glutaraldehyde, terephthalaldehyde and mixtures thereof and from polyol carboxylic acids such as gluconic acid and/or glucoheptonic acid.

Further suitable organic builder substances are dextrins, for example oligomers or polymers of carbohydrates which can be obtained by partial hydrolysis of starches. The hydrolysis may be carried out according to customary methods, for example acid-catalyzed or enzyme-catalyzed methods. These are preferably hydrolysis products having average molecular weights in the range from 400 to 500,000 g/mol. Preference is given here to a polysaccharide having a dextrose equivalent (DE) in the range from 0.5 to 40, in particular from 2 to 30, DE being a common measure of the reducing effect of a polysaccharide in comparison to dextrose, which has a DE of 100. It is also possible to use both maltodextrins having a DE between 3 and 20 and dry glucose syrups having a DE between 20 and 37 and also so-called yellow dextrins and white dextrins having higher molecular weights in the range from 2000 to 30,000 g/mol. One preferred dextrin is described in the British patent application 9419091. The oxidized derivatives of such dextrins are the reaction products thereof with oxidizing agents which are capable of oxidizing at least one alcohol function of the saccharide ring to the carboxylic acid function. Such oxidized dextrins and processes for the preparation thereof are known for example from European patent applications EP 0232202 A, EP 0427349 A, EP 0472042 A and EP 0542496 A and from international patent applications WO 92/18542, WO 93/08251 A, WO 93/16110 A, WO 94/28030 A, WO 95/07303 A, WO 95/12619 A and WO 95/20608 A. An oxidized oligosaccharide according to German patent application DE 19600018 A is also suitable. A product oxidized at $C_6$ of the saccharide ring may be particularly advantageous.

Oxydisuccinates and other derivatives of disuccinates, preferably ethylenediamine disuccinate, are also further suitable cobuilders. Ethylenediamine-N,N'-disuccinate (EDDS), the synthesis of which is described for example in U.S. Pat. No. 3,158,615, is preferably used in the form of the sodium or magnesium salts thereof. In this connection, preference is also given to glycerol disuccinates and glycerol trisuccinates, as described for example in the U.S. Pat. No. 4,524,009, U.S. Pat. No. 4,639,325, in European patent application EP 0150930 A and in Japanese patent application JP 93/339896. Suitable use amounts in zeolite-containing and/or silicate-containing formulations are from 3 to 15% by weight.

Further organic cobuilders which can be used are for example acetylated hydroxycarboxylic acids and salts thereof, which may optionally also be in lactone form and which contain at least 4 carbon atoms and at least one hydroxyl group and at most two acid groups. Such cobuilders are described for example in international patent application WO 95/20029 A.

A further substance class having cobuilder properties is the phosphonates, in particular hydroxyalkane or aminoalkane phosphonates. Among the hydroxyalkane phosphonates, 1-hydroxyethane-1,1-diphosphonate (HEDP) is of particular importance as a cobuilder. It is preferably used as the sodium salt, the disodium salt showing a neutral reaction and the tetrasodium salt showing an alkaline reaction (pH 9). Preferred aminoalkane phosphonates are ethylenediamine tetramethylene phosphonate (EDTMP), diethylenetriamine pentamethylene phosphonate (DTPMP) and higher homologs thereof. They are preferably used in the form of the neutrally reacting sodium salts, for example as the hexasodium salt of EDTMP or as the heptasodium and octasodium salt of DTPMP. From the phosphonate class, preferably HEDP will be used as builder. The aminoalkane phosphonates moreover exhibit an excellent heavy metal binding capacity. It may therefore be preferred, particularly when the agents also contain bleaches, to use aminoalkane phosphonates, in particular DTPMP, or mixtures of the aforementioned phosphonates.

In addition, all compounds capable of forming complexes with alkaline earth metal ions can be used as cobuilders.

One inorganic builder which is used with preference is finely crystalline, synthetic zeolite containing bound water. The finely crystalline, synthetic zeolite containing bound water which is used is preferably zeolite A and/or P. However, zeolite X is also suitable, as are mixtures of A, X and/or P, for example a co-crystallisate of zeolites A and X. The zeolite may be used as a spray-dried powder or else as an undried stabilized suspension still moist from its production. Where the zeolite is used as a suspension, this may contain small additions of non-ionic surfactants as stabilizers, for example 1 to 3% by weight, based on zeolite, of ethoxylated $C_{12}$-$C_{18}$ fatty alcohols having 2 to 5 ethylene oxide groups, $C_{12}$-$C_{14}$ fatty alcohols having 4 to 5 ethylene oxide groups, or ethoxylated isotridecanols. Suitable zeolites have a mean particle size of less than 10 μm (volume distribution; measurement method: Coulter Counter) and contain preferably 18 to 22% by weight, in particular 20 to 22% by weight of bound water. In preferred embodiments, zeolites are contained in the premix in amounts of 10 to 94.5% by weight, wherein it may be particularly preferred if zeolites are contained in amounts of 20 to 70, in particular 30 to 60% by weight.

Suitable partial substitutes for zeolites are layer silicates of natural and synthetic origin. Such layer silicates are known for example from patent applications DE 2334899 A, EP 0026529 A and DE 3526405 A. The usability thereof is not restricted to a specific composition or structural formula. However, preference is given here to smectites and in particular bentonites. Also suitable for substituting zeolites or phosphates are crystalline, layer-form sodium silicates of general formula $NaMSixO_{2x-1}.yH_2O$, where M is sodium or hydrogen, x is a number from 1.9 to 4 and y is a number from 0 to 20, preferred values for x being 2, 3 or 4. Such crystalline layer silicates are described for example in European patent application EP 0164514 A. Preferred crystalline layer silicates of the aforementioned formula are those in which M is sodium and x assumes the value 2 or 3. Particular preference is given to both β- and δ-sodium disilicates $Na_2Si_2O_5.yH_2O$.

The preferred builder substances also include amorphous sodium silicates having a modulus $Na_2O:SiO_2$ of 1:2 to 1:3.3, preferably 1:2 to 1:2.8 and in particular 1:2 to 1:2.6, which dissolve with delay and have secondary wash properties. The delay in dissolving compared to conventional amorphous sodium silicates may have been brought about in various ways, for example by surface treatment, compounding, compacting/compressing or by overdrying. In the context of this invention, the term "amorphous" will also be understood to mean "X-ray amorphous". In other words, the silicates do not produce any of the sharp X-ray reflexes typical of crystalline substances in X-ray diffraction experiments, but at best one or more maxima of the scattered X-ray radiation which have a width of several degrees of the diffraction angle. However, particularly good builder properties may be achieved even if the silicate particles produce crooked or even sharp diffraction maxima in electron diffraction experiments. This is to be interpreted to mean that the products have microcrystalline regions having a size from 10 to a few hundred nm, preference being given to values of up to at most 50 nm and in particular up to at most 20 nm. Such so-called X-ray amorphous silicates, which likewise dissolve with delay compared to conventional waterglasses, are described for example in German patent application DE 4400024 A. Particular preference is given to compressed/compacted amorphous silicates, compounded amorphous silicates and overdried X-ray-amorphous silicates, wherein in particular the overdried silicates are preferably also present as carriers in the granules according to the invention or are used as carriers in the method according to the invention.

Further suitable inorganic builder substances are the carbonates, in particular sodium carbonate.

Of course, it is also possible to use the generally known phosphates as builder substances, unless such a use should be avoided for ecological reasons. The sodium salts of orthophosphates, pyrophosphates and in particular tripolyphosphates are particularly suitable. The content thereof is generally no more than 25% by weight, preferably no more than 20% by weight, in each case based on the finished agent. In some cases, it has been found that tripolyphosphates in particular, even in small amounts up to at most 10% by weight, based on the finished agent, in combination with other builder substances lead to a synergistic improvement of the secondary wash performance.

The washing or cleaning agent may also contain at least one enzyme. In principle, all enzymes established for this purpose in the prior art can be used. Preferably, it contains one or more enzymes which can display catalytic activity in a washing or cleaning agent, in particular a protease, amylase, lipase, cellulase, hemicellulase, mannanase, pectin-cleaving enzyme, tannase, xylanase, xanthanase, β-glucosidase, carrageenase, perhydrolase, oxidase, oxidoreductase, and mixtures thereof. Preferred hydrolytic enzymes include in particular proteases, amylases, in particular α-amylases, cellulases, lipases, hemicellulases, in particular pectinases, mannanases, β-glucanases, and mixtures thereof. Particular preference is given to proteases, amylases and/or lipases and mixtures thereof, and very particular preference is given to proteases. These enzymes are in principle of natural origin; starting from the natural molecules, improved variants are available for use in washing or cleaning agents, which are accordingly used with preference.

The enzymes to be used may be conditioned together with concomitant substances, for example from the fermentation, or with stabilizers.

Suitable as bleaching agents are all substances which, by oxidation, reduction or absorption, break down or absorb dyes and thus decolor materials. These include, inter alia, hypohalite-containing bleaching agents, hydrogen peroxide, perborate, percarbonate, peroxoacetic acid, diperoxoazelaic acid, diperoxododecanedioic acid and oxidative enzyme systems.

Besides the aforementioned constituents, the washing or cleaning agents according to the invention may additionally contain one or more of the substances additionally mentioned above, in particular those from the groups of bleach activators, pH adjusting agents, perfumes, perfume carriers, fluorescing agents, dyes, silicone oils, anti-redeposition agents, optical brighteners, graying inhibitors and color transfer inhibitors. Suitable agents are known in the prior art.

This list of washing or cleaning agent ingredients is in no way final but rather merely reflects the most important typical ingredients of such agents. In particular, if preparations in liquid, paste or gel form are concerned, the agents may also contain organic solvents. Preferably these are monovalent or polyvalent alcohols having 1 to 4 C atoms. Preferred alcohols in such agents are ethanol, 1,2-propanediol, glycerol and mixtures of these alcohols. In preferred embodiments, such agents contain 2 to 12% by weight of such alcohols.

In principle, the agents may have different aggregate states. In one preferred embodiment, the washing or cleaning agents are agents in the form of powder or granules. The agents according to the invention may in this case have any bulk densities. The range of possible bulk densities extends from low bulk densities of less than 600 g/l, for example 300 g/l, through the range of medium bulk densities of 600 to 750 g/l, to the range of high bulk densities of at least 750 g/l. In other embodiments, the washing or cleaning agent is in the form of shaped articles, these preferably being tablets which may consist of a single phase or else of multiple, in particular 2 or 3, different phases.

Any methods known from the prior art are suitable for producing the washing or cleaning agents described herein.

Washing or cleaning methods, that is to say in particular methods for cleaning fabrics, are generally characterized in that, in one or more method steps, active cleaning substances are applied to the article to be cleaned and are washed off after a treatment time, or in that the article to be cleaned is treated in some other way with a washing or cleaning agent or a solution of this agent.

In the described washing or cleaning methods, in particular washing methods, in different embodiments of the invention temperatures of up to 95° C. or less, 90° C. or less, 60° C. or less, 50° C. or less, 40° C. or less, 30° C. or less or 20° C. or less are used. These specified temperatures refer to the temperatures used in the washing or cleaning steps.

In different embodiments, preference is given to washing or cleaning methods in which air is continuously introduced into the washing liquor.

The methods according to the invention are preferably washing methods. The washing methods are preferably carried out in tub-type washing machines, in particular in those having a static liquor tank and a stirring or circulating device. The stirring or circulating device may in this case be arranged on the bottom or on the side of the liquor tank. It is preferred here that the stirring or circulating device is arranged in such a way that, during the stirring or circulating operation, air is continuously introduced into the washing liquor. Such tub-type washing machines are used as HS machines of the "Ideal" type for example in Egypt, or as machines of the "Sibir", "Feya" and "Mini Vjatka" type in Russia.

In different embodiments of the method described herein, the washing solution can be used for multiple wash loads, that is to say multiple successive wash cycles can be carried out using the same washing liquor.

As already described above, the invention also relates to the use of at least one alkylamidopropyl betaine as defined above for improving the foaming characteristics of a washing or cleaning agent, in particular in the presence of soil, very particularly under high soil loading, wherein the washing or cleaning agent is one as defined herein.

"High soil loading", as used herein, refers generally to large amounts of soil relative to the amount of washing liquor. Articles which are soiled, such as fabrics for example, increase the soil loading of the washing or cleaning liquor when they are introduced into the washing or cleaning liquor. The expression high soil loading is used when the soil in the washing or cleaning liquor brings about a defoaming effect as obtained when there is more than 3 g of soil/l of washing or cleaning liquor, preferably more than 4 g of soil/l of washing or cleaning liquor, which is set using WFK SBL cloths in a washing liquor in accordance with the test method presented in the examples. Furthermore, the expression high soil loading is used when, under control conditions, that is to say in the absence of short-chain alkylamidopropyl betaine, the foam height is reduced by at least 5, at least 10, at least 20, at least 30, at least 40 or at least 50%. Most preferably, the high soil loading leads to an at least 20% reduction in the foam height. The foam height is determined in accordance with the test method explained in the examples for determining the foam height (cf. "Carrying out the foam tests") under suitably adapted conditions after 15 minutes.

In particular, the short-chain alkylamidopropyl betaines and anionic surfactants disclosed as preferred embodiments above are likewise preferred for the described use. The washing or cleaning agent is preferably a washing or cleaning agent in solid form, in particular in the form of powder or granules, and/or contains the individual surfactant constituents in the amounts and ratios disclosed above in connection with the disclosed washing or cleaning agent. In further embodiments, the washing or cleaning agent is preferably a washing or cleaning agent in liquid, paste or gel form. The washing or cleaning agent in liquid, paste or gel form may contain the individual surfactant constituents in the amounts and ratios disclosed above in connection with the disclosed washing or cleaning agent.

All facts, subjects and embodiments described for the washing or cleaning agents are also applicable to the washing method and the use, and vice versa.

General Definitions

All the documents cited herein are hereby incorporated in their entirety by way of reference. The inventions described herein for illustrative purposes can be suitably carried out in the absence of any element or elements, limitation or limitations, which are not specifically disclosed here. For example, the terms "comprising", "including", "containing", etc. can be interpreted broadly and without limitation. In addition, the terms and expressions are used only for descriptive purposes and are not used for limiting purposes, and there is no intention when using such terms and expressions to rule out any equivalents of the illustrated and described features or parts thereof; instead, it is obvious that various modifications are possible within the scope of the claimed invention. It will thus be understood that, although the present invention is disclosed specifically on the basis of preferred embodiments and optional features, modifications and variations of the inventions, the person skilled in the art can use these and new modifications and variations can be developed which lie within the scope of the present invention. The invention has been described in a broad and generic manner. Each of the narrower species and subgroups falling within the general disclosure are likewise part of the invention. This includes the generic description of the invention with a reservation or negative limitation which rules out generic subject matters, regardless of whether the material ruled out is specifically indicated here. In cases where features or aspects of the invention are described in the form of Markush groups, persons skilled in the art will recognize that the invention is thereby also described with regard to each individual member or sub-group of members of the Markush group. Further embodiments of the invention will become apparent from the following claims.

EXAMPLES

Example 1: Foam Test

Preparation of the Concentrated Soiled Liquor:

41 of tap water (water hardness 16°dH, temperature 20° C.) were filled into a 5 l glass beaker and a commercially available high-suds washing agent (X-Tra High Suds Egypt; LAS content 17% by weight) was added in a dosage of 3 g/l. The washing agent was dissolved for 10 minutes at 150 rpm using a paddle-type stirrer (10 cm diameter). Thereafter, SLB-2004 cotton cloths (8 g soil/cloth, wfk Testgewebe GmbH, DE) (cut into small pieces) were added in a proportion of 1 SBL cloth per 11 of washing liquor. After stirring for a further 1 h, the washed SBL cloths were removed. The finished soiled liquor continued to be stirred at 150 rpm until it was used. The soil concentration was 4.6 g/l.

Carrying Out the Foam Tests:

By mixing in each case 250 ml of the concentrated soiled liquor described above and the same amount of clean liquor containing 3 g/l of the same washing agent but no soil, an initially less soiled washing liquor was produced (theoretical amount of soil 2.3 g/1), and the additive to be tested in each case was added (according to the invention: Tegotens® B 810 (=$C_{8/10}$-amidopropyl betaine ($C_{8/10}$APB)) from Evonik Industries; comparative example: LAS) and the mixture was filled into a test cylinder (internal diameter 8 cm, internal height 46.5 cm) of a Contifoam® foam tester. The foam test begins at the time t=0 with the starting of the circulating pump of the Contifoam® foam tester (1.5 l/min). In this test, the washing liquor is sucked through the pump and injected back into the sample solution through a nozzle (0.5 cm diameter) from a height of 45 cm. The foam is generated by the air introduced as a result. The temperature was constantly 23° C. The respective foam height and foam volume were recorded as a function of time.

After t=5 minutes, 250 ml of liquor were removed from the foam tester and replaced by 250 ml of the concentrated soiled liquor (likewise with the respective additive added). This resulted, by calculation, in a soil concentration of 3.45 g/l. The foam test was continued and the foam volume was recorded as a function of time over 30 minutes.

In Table 1, the results are shown as the foam volumes of the formulations (E) according to the invention and of the comparative formulations (V) after t=26 minutes. The percentages always relate here to the active substance of the additives based on the washing agent used ("on top"). The values specified in the table are mean values from 5 determinations. The standard deviations are approximately ±100 ml. The specified amount of LAS relates to the added amount of LAS, that is to say to the amount of LAS in addition to the LAS already contained in the washing agent. In the ratio of betaine ($C_{8/10}$APB) to LAS, the amount of LAS here is the amount of LAS contained in the washing agent.

TABLE 1

| Sample | LAS | C8/10APB | Ratio C8/10APB/ LAS | Foam volume (ml) |
|---|---|---|---|---|
| V0 | — | — | — | 810 |
| V1 | 0.6% by weight | — | — | 800 |
| E1 | — | 0.6% by weight | 0.036 | 1253 |
| V2 | 1.0% by weight | — | — | 825 |
| E2 | — | 1.0% by weight | 0.059 | 1075 |
| V3 | 1.5% by weight | — | — | 1010 |
| E3 | — | 1.5% by weight | 0.087 | 1065 |
| V4 | 2.0% by weight | — | — | 1100 |
| E4 | — | 2.0% by weight | 0.12 | 1050 |
| V5 | 3.0% by weight | — | — | 1175 |
| V6 | — | 3.0% by weight | 0.182 | 950 |

The results show that an addition of the short-chain alkylamidopropyl betaine in low ratios relative to LAS leads to a significant increase in the foam volume and this increase in the foam volume decreases again as the amounts of betaine increase.

In order to demonstrate that the foam volume is increased only in the presence of relatively large amounts of soil, a further test was carried out in which the test protocol was adapted as follows: Firstly 125 ml of the concentrated soiled liquor were mixed with 375 ml of clean liquor. The initial soil concentration was thus 1.15 g/l. After 5 minutes, 125 ml of the sample solution were replaced by 125 ml of soiled liquor with added additive, so that the soil concentration was 1.75 g/l. Table 2 shows the foam volumes after t=15 minutes.

TABLE 2

| Sample | LAS | C8/10APB | Ratio C8/10APB/ LAS | Foam volume (ml) |
|---|---|---|---|---|
| E1 | — | 0.6% by weight | 0.036 | 1000 |
| V7 | 0.6% by weight | — | — | 1000 |

This result shows that, with a low soil loading, the foam volumes in the context of statistical scattering and read accuracy are approximately identical. This property brings the advantage that the excessive foaming of the washing machine at the start of a series of wash cycles is avoided.

In order to demonstrate that the improvement in the foam properties can be attributed to the specifically used betaine, comparative tests were carried out using longer-chain alkylamidopropyl betaines, here cocoamidopropyl betaine (CAPB), that is to say essentially C12-alkylamidopropyl betaine, in a manner analogous to the tests described above. The results are shown in Table 3.

TABLE 3

| Sample | LAS | C8/10APB | Ratio C8/10APB/ LAS | Foam volume (ml) |
|---|---|---|---|---|
| E1 | — | 0.6% by weight | 0.036 | 1253 |

TABLE 3-continued

| Sample | LAS | C8/10APB | Ratio C8/10APB/ LAS | Foam volume (ml) |
|---|---|---|---|---|
| V8 | 0.6% by weight | — | 0.036 | 950 |

The results show that a greater foam volume can be achieved only with the short-chain alkylamidopropyl betaines according to the invention.

Example 2: Practical Test, Washing Machine

Use was made of a tub-type washing machine of the "Ideal" type having a lateral agitator, which is common in the market in Egypt and other countries outside of Central Europe. The quantity of water was 33 liters, the water hardness was 16° dH and the water temperature was 20° C. As ballast laundry, 5 hand towels were always added to the wash load. Using the same washing liquor, 6 wash cycles, each lasting 8 minutes, were carried out one after the other. As is routine in the areas in question, a total dose of 100 g of washing agent was used, namely 50 g in the first wash cycle and a further 50 g in the second wash cycle. To increase the amount of soil during these wash cycles, SBL-2004 cloths were added in each wash cycle, namely 3 cloths in each of the 1st, 4th, 5th and 6th wash cycles and 6 cloths in each of the 2nd and 3rd wash cycles, that is to say 24 cloths in total. At the end of the respective wash cycle, the foam height was read using a scale.

Using this protocol, two formulations E5 and E6 according to the invention were tested, which were each based on a commercially available washing agent containing 15% by weight LAS and to which respectively 0.26% by weight and 0.39% by weight $C_{8/10}$APB were added on top. A commercially available formulation containing 17% by weight LAS was used as comparative example V19. The foam heights and the relative improvements of the formulations according to the invention are shown in Table 4.

TABLE 4

| | E5 15% LAS, 0.26% C8/10APB | | E6 15% LAS, 0.39% C8/10APB | | V9 17% LAS |
|---|---|---|---|---|---|
| Wash cycle | Foam height (cm) | Relative improvement (%) | Foam height (cm) | Relative improvement (%) | Foam height (cm) |
| 1 | 5.7 | 16 | 5.7 | 6 | .9 |
| 2 | 6.1 | 5 | 6.4 | 0 | .8 |
| 3 | 3.8 | 36 | 3.9 | 39 | 2.8 |
| 4 | 3.2 | 28 | 3.4 | 36 | 2.5 |
| 5 | 2.4 | 33 | 3.3 | 83 | 1.8 |
| 6 | 2.3 | 44 | 2.7 | 69 | 1.6 |

The results clearly show the improvements over the comparative formulation. In particular, it can be seen that the increase in the foam volume occurs in particular in the later wash cycles, in which there is a higher soil loading of the liquor, while the effect at the start in cleaner washing liquor is minor. Excessive foaming is thus avoided, while nevertheless at the end of the series the foam of the formulations according to the invention is considerably higher.

Example 3: Exemplary Compositions 1-80 According to the Invention

| No. | Anionic surfactant | C8/ 10APB | Total APB |
|---|---|---|---|
| 1 | 3 | 0.009 | 0.009 |
| 2 | 3 | 0.009 | 0.036 |
| 3 | 3 | 0.36 | 0.36 |
| 4 | 3 | 0.36 | 1.44 |
| 5 | 4 | 0.012 | 0.012 |
| 6 | 4 | 0.012 | 0.048 |
| 7 | 4 | 0.48 | 0.48 |
| 8 | 4 | 0.48 | 1.92 |
| 9 | 5 | 0.015 | 0.015 |
| 10 | 5 | 0.015 | 0.06 |
| 11 | 5 | 0.6 | 0.6 |
| 12 | 5 | 0.6 | 2.4 |
| 13 | 7.5 | 0.0225 | 0.0225 |
| 14 | 7.5 | 0.0225 | 0.09 |
| 15 | 7.5 | 0.9 | 0.9 |
| 16 | 7.5 | 0.9 | 3.6 |
| 17 | 10 | 0.03 | 0.03 |
| 18 | 10 | 0.03 | 0.12 |
| 19 | 10 | 1.2 | 1.2 |
| 20 | 10 | 1.2 | 4.8 |
| 21 | 15 | 0.045 | 0.045 |
| 22 | 15 | 0.045 | 0.18 |
| 23 | 15 | 1.8 | 1.8 |
| 24 | 15 | 1.8 | 7.2 |
| 25 | 20 | 0.06 | 0.06 |
| 26 | 20 | 0.06 | 0.24 |
| 27 | 20 | 2.4 | 2.4 |
| 28 | 20 | 2.4 | 9.6 |
| 29 | 25 | 0.075 | 0.075 |
| 30 | 25 | 0.075 | 0.3 |
| 31 | 25 | 3 | 3 |
| 32 | 25 | 3 | 12 |
| 33 | 30 | 0.09 | 0.09 |
| 34 | 30 | 0.09 | 0.36 |
| 35 | 30 | 3.6 | 3.6 |
| 36 | 30 | 3.6 | 14.4 |
| 37 | 35 | 0.105 | 0.105 |
| 38 | 35 | 0.105 | 0.42 |
| 39 | 35 | 4.2 | 4.2 |
| 40 | 35 | 4.2 | 16.8 |
| 41 | 3 | 0.009 | 0.009 |
| 42 | 3 | 0.009 | 0.036 |
| 43 | 3 | 0.36 | 0.36 |
| 44 | 3 | 0.36 | 1.44 |
| 45 | 4 | 0.012 | 0.012 |
| 46 | 4 | 0.012 | 0.048 |
| 47 | 4 | 0.48 | 0.48 |
| 48 | 4 | 0.48 | 1.92 |
| 49 | 5 | 0.015 | 0.015 |
| 50 | 5 | 0.015 | 0.06 |
| 51 | 5 | 0.6 | 0.6 |
| 52 | 5 | 0.6 | 2.4 |
| 53 | 7.5 | 0.0225 | 0.0225 |
| 54 | 7.5 | 0.0225 | 0.09 |
| 55 | 7.5 | 0.9 | 0.9 |
| 56 | 7.5 | 0.9 | 3.6 |
| 57 | 10 | 0.03 | 0.03 |
| 58 | 10 | 0.03 | 0.12 |
| 59 | 10 | 1.2 | 1.2 |
| 60 | 10 | 1.2 | 4.8 |
| 61 | 15 | 0.045 | 0.045 |
| 62 | 15 | 0.045 | 0.18 |
| 63 | 15 | 1.8 | 1.8 |
| 64 | 15 | 1.8 | 7.2 |
| 65 | 20 | 0.06 | 0.06 |
| 66 | 20 | 0.06 | 0.24 |
| 67 | 20 | 2.4 | 2.4 |
| 68 | 20 | 2.4 | 9.6 |
| 69 | 25 | 0.075 | 0.075 |
| 70 | 25 | 0.075 | 0.3 |
| 71 | 25 | 3 | 3 |
| 72 | 25 | 3 | 12 |
| 73 | 30 | 0.09 | 0.09 |

-continued

| No. | Anionic surfactant | C8/ 10APB | Total APB |
|---|---|---|---|
| 74 | 30 | 0.09 | 0.36 |
| 75 | 30 | 3.6 | 3.6 |
| 76 | 30 | 3.6 | 14.4 |
| 77 | 35 | 0.105 | 0.105 |
| 78 | 35 | 0.105 | 0.42 |
| 79 | 35 | 4.2 | 4.2 |
| 80 | 35 | 4.2 | 16.8 |

All figures are given in % by weight based on the total weight of the washing or cleaning agent. The remainder to 100% by weight is made up of customary constituents of washing or cleaning agents. Total APB means the total content of alkylamidopropyl betaine in the washing agent and includes $C_{8/10}$APB.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A washing or cleaning agent comprising:

(i) 15% by weight to 20% by weight at least one linear alkylbenzene sulfonate surfactant, based on the total weight of the washing or cleaning agent and (ii) $C_{8/10}$ alkylamidopropyl betaine;

wherein the weight ratio of the alkylamidopropyl betaine according to (ii)/total amount of linear alkylbenzene sulfonate surfactant in the washing or cleaning agent is from 0.036 to 0.087, wherein the weight ratio of the total amount of alkylamidopropyl betaine according to (ii)/total amount of alkylamidopropyl betaine in the washing or cleaning agent is 0.25 to 1.0.

2. The washing or cleaning agent according to claim 1, characterized in that the at least one first linear alkylbenzene sulfonate surfactant is a linear $C_{6-19}$ alkylbenzene sulfonate.

3. The washing or cleaning agent according to claim 1, characterized in that the washing or cleaning agent further contains at least one constituent selected from the group consisting of enzymes, bleaching agents, complexing agents, builders, electrolytes, non-aqueous solvents, pH adjusting agents, perfumes, perfume carriers, fluorescing agents, dyes, speckles, hydrotropes, silicone oils, anti-redeposition agents, graying inhibitors, shrinkage preventers, anti-crease agents, color transfer inhibitors, antimicrobial active substances, germicides, fungicides, antioxidants, preservatives, corrosion inhibitors, antistatic agents, bittering agents, ironing adjuvants, proofing and impregnating agents, swelling and anti-slip agents, softening components and UV absorbers.

4. The washing or cleaning agent according to claim 1, characterized in that the washing or cleaning agent is an agent in the form of a powder or granules or is a solid shaped article.

5. A washing or cleaning method, comprising the method steps:

(i) providing a washing or cleaning solution including a washing or cleaning agent according to claim 1, wherein the washing or cleaning solution includes soil;

(ii) bringing a soiled fabric, into contact with the washing or cleaning solution according to (i).

6. The washing or cleaning method according to claim 5, characterized in that the method is a washing method, wherein (i) the washing method is carried out in a washing machine having a static liquor tank and a stirring or circulating device arranged on the bottom or on the side of the liquor tank; and/or (ii) the washing or cleaning solution is used for multiple wash loads.

* * * * *